United States Patent [19]

Garpentin et al.

[11] Patent Number: 4,934,276

[45] Date of Patent: Jun. 19, 1990

[54] RAIL FOR OVERHEAD RAIL SYSTEMS

[75] Inventors: Manfred Garpentin, Herdecke; Johannes-Gerhard Spoeler, Borken, both of Fed. Rep. of Germany

[73] Assignee: Mannesmann AG, Duesseldorf, Fed. Rep. of Germany

[21] Appl. No.: 842,756

[22] Filed: Mar. 21, 1986

Related U.S. Application Data

[63] Continuation of Ser. No. 560,770, Dec. 12, 1983, abandoned.

[30] Foreign Application Priority Data

Dec. 10, 1982 [DE] Fed. Rep. of Germany ..... 3245691

[51] Int. Cl.[5] ..... E01B 25/22

[52] U.S. Cl. ..... 104/111

[58] Field of Search ..... 104/106, 107, 111, 91, 104/110, 93; 238/249, 243, 260; 403/337, 408, 312

[56] References Cited

U.S. PATENT DOCUMENTS

| | | | |
|---|---|---|---|
| 883,089 | 3/1908 | Collier | 238/249 |
| 1,768,911 | 7/1930 | Koster et al. | 104/111 X |
| 4,184,785 | 1/1980 | Marjollet et al. | 403/408 X |
| 4,393,785 | 7/1983 | Härtnagel | 104/110 |

FOREIGN PATENT DOCUMENTS

| | | | |
|---|---|---|---|
| 485377 | 3/1926 | Fed. Rep. of Germany | 104/110 |
| 457573 | 3/1928 | Fed. Rep. of Germany | 104/110 |
| 485503 | 10/1929 | Fed. Rep. of Germany | 104/110 |
| 851823 | 10/1960 | United Kingdom | 104/106 |

*Primary Examiner*—Margaret A. Focarino
*Assistant Examiner*—Frank H. William, Jr.
*Attorney, Agent, or Firm*—Ralf H. Siegemund

[57] ABSTRACT

A rail connection for use in an overhead suspended rail system comprises a plate bolted to the webs of the rails and upper and lower connecting structures with undercut portions for engagement with a suspension element.

2 Claims, 1 Drawing Sheet

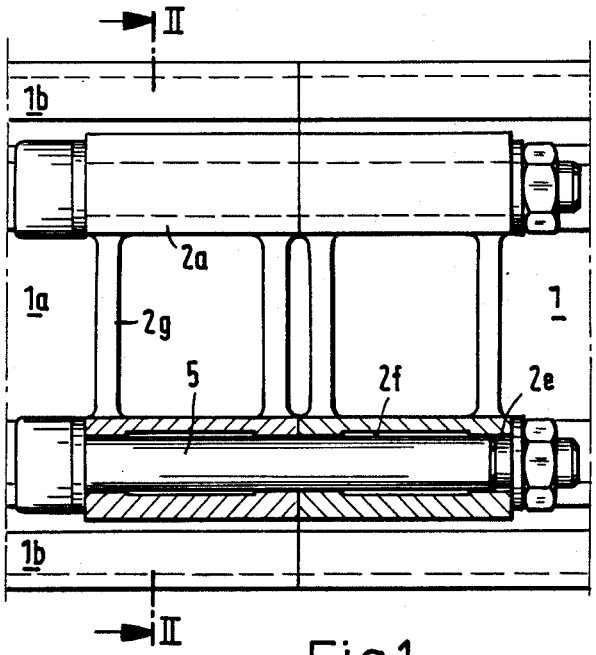
Fig.1
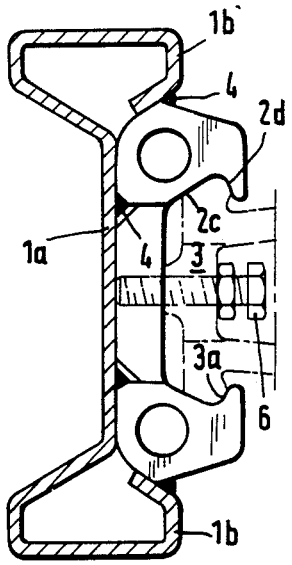
Fig.2
Fig.3
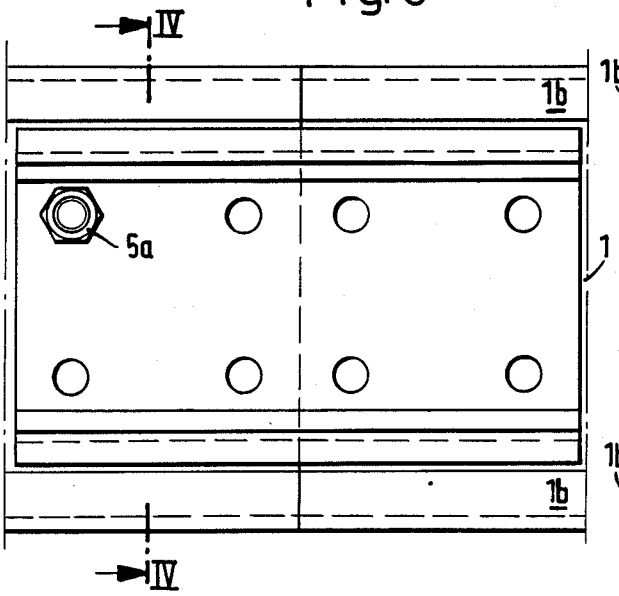
Fig.4
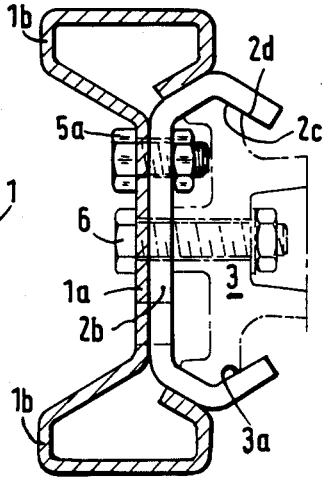

RAIL FOR OVERHEAD RAIL SYSTEMS

This application is a continuation of application Ser. No. 560,770, filed Dec. 12, 1983, now abandoned.

BACKGROUND OF THE INVENTION

The present invention relates to the interconnection of rails for overhead rail systems having connecting pieces at their ends for purposes of affixing thereto an adjoining rail, for example, by means of screws or the like. Rails of the type to which the invention pertains are known generally, for example, through the German patent 12 49 301. This rail is provided at its upper part with a centrally disposed, tubular connecting sleeves for screws or bolts while similar connecting sleeves are provided on both sides below the rail. These elements provide for the connection with the respective rails adjoining at one end respectively and the opposite end. Generally speaking, such a rail is sufficiently strong even at the point of connection. However, this mode of connection is disadvantaged by the fact that the centrally disposed upper connecting sleeve makes it impossible to suspend the rail in the usually fashion.

German printed patents 23 42 777 and 30 19 301 (see U.S. Pat. No. 4,393,780) disclose other rails of the type to which the invention pertains, being of a more general nature in this regard. However, these rails are likewise disadvantaged by the fact that the connecting points do not permit suspension. Moreover, the conditions are even made more difficult through sliding or gliding connections arranged on one side of the web portion of the rail.

DESCRIPTION OF THE INVENTION

It is an object of the present invention to provide a new and improved interrail connection for overhead rail systems to be used for suspending vehicles whereby the rails are constructed such that they can be suspended even in the zone or area of the connection without weakening the rail construction as such.

In accordance with the preferred embodiment of the present invention, it is suggested to utilize the principle of employing connecting sleeves with bolts. However, these elements are arranged between the generally vertically disposed web of the rail and the adjoining cord flange or girth portion. Therefore, it is particularly suggested to provide the connecting sleeves in the corner between the web and the flange portion. This feature establishes sufficient strength of the rail in vertical as well as in horizontal direction right in the zone in which the connection is made because the respective surfaces of contact are forced against each other by means of the bolts. This is not altered by the fact that rail suspension element such as a plate may be connected at that point.

Preferably one will provide connecting sleeves only on one side of the web so that the other side remains available without impediment for the connection of current collector lines. The upper connecting sleeves are connected with the lower connecting sleeves by means of at least one web or bar so that the support force of the rail suspending plate will not only be reacted into the upper flange but also into the lower one of the rail. Preferably one, however, will use two such webs and arrange them in the vicinity of the respective ends of these connecting sleeves so that the sleeves will not bind but will remain oriented to each other as intended.

The connecting sleeves are connected to the respective rail by means of two welding seams which run along the axis of the several sleeves whereby the transition from connecting sleeve to rail and flange establish bottoms for V-shaped welding seams. Such a welding seam can be deposited quite simply between the respective flange of the rail and the sleeve. Also, the second welding seam between tubular connecting sleeve and rail web is easily accessible through the window established between the sleeve web.

The connecting sleeves are threaded and these threads may be provided with enlargements near their ends so that in the case of a distortion of a respective connecting sleeve during welding subsequent threading of a bolt will not be interfered with or impeded. The bolts for that purpose as well as the sleeves or at least one of these elements should be made of a high strength material so that these elements as they are incorporated into the rail structure establish the same load-bearing capabilities as the other part of the rail system even though the rail proper is locally interrupted to some extent in these locations.

The connecting piece for interconnecting adjacent rails can be modified or even differently constructed in case there are lower loads and less wear to be expected. The above mentioned connecting sleeves may be replaced by a connecting bar or plate which is fastened to the two adjoining ends of two rails to be interconnected. Such a connecting piece is then preferably bolted or riveted to the web of the other one of the rails to be interconnected. Alternatively, the connecting plate may be welded to the flange of the rail by means of surfaces in edge portions provided for that purpose.

In furtherance of the invention, the connecting elements, sleeves or plates are provided with abutment surfaces and the rail suspension element mentioned earlier is provided with undercut security edges preventing slipoff so that the rails may even be connected to the suspension element during assembly without any danger of slippage. The suspension elements by means of which the rails will be suspended will bear directly against the rail webs between the respective connections under support of the rails. These suspension elements extend from inside against the rail flanges and are cut for purposes of matching the respective abutment surfaces. Connecting the suspension elements to the respective connection elements requires that the suspension elements are offset with respect to the rails by a distance equal to the thickness of the respective interrail connecting elements. However, the suspension as provided by this suspension structure ensures that deviations can be readily compensated.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

FIG. 1 is a side elevation, partially in section of an interrail connection for overhead rail systems under utilization of connecting sleeves in accordance with the preferred embodiment of the preferred invention for practicing the best mode thereof;

FIG. 2 is a section taken in a plane indicated by II—II in FIG. 1;

FIG. 3 illustrates a modified interrail connection in side elevation using connecting pieces; and FIG. 4 is a section view taken in a plane indicated in FIG. 3 by IV—IV.

Proceeding now to the detailed description of the drawings, FIGS. 1 and 2 illustrate rails 1 and 1' and here particularly ends of these rails in an abutting relationship. Each such rail is provided with a central web portion 1*a*, an upper flange construction 1*b* and a lower flange construction 1*c*. The rail 1, for example, is provided with an upper connecting sleeve 2*a* and a lower connecting sleeve 2*b*. Webs or bars 2*g* interconnect these two sleeves.

As can be seen best from FIG. 2 the upper connecting sleeve 2*a* is welded to the flange structure 1*b* through a welding seam 4 which runs longitudinally with the rail system which is axis parallel as far as the sleeve 2*a* is concerned. Analogously there is a welding seam 4*a* provided between the sleeve 2*a* and the web structure 1*a* of the rail. Both welding seams have V-groove like bottoms.

FIG. 2 illustrates also an overhung abutment surface 2*c* being continuous with an edge 2*d* for preventing slipping of the suspension element 3 illustrated only in dotted lines and pertaining to the suspension structure by means of which the rails are suspended. The suspension element 3 is specifically provided with abutment surfaces 3*a* being in engagement with these safety edges 2*d*. A bolt 6 urges the rear edge of abutment surface 3*a* against the safety edge 2*d* of the respective connecting sleeve. Of course, all these features are, as far as one rail end is concerned, provided in duplicate to establish the same relationship with regard to the flange 1*c*, and the adjoining rail is analogously provided with these structural elements. Consequently, these connecting sleeves such as 2*a* are aligned in pairs and the joint between the two rails serves as a kind of plane of symmetry.

Bores are provided, such as bore 2*e*, which are threaded for receiving bolts such as 5. These bolts, of course, interconnect aligned pairs of connecting sleeves pertaining to different rails. In accordance with the specific feature of the invention these bores are widened where indicated by a number 2*f* in order to prevent binding.

FIGS. 3 and 4 illustrate analogously two rail ends and the connection is provided here by means of a single connecting plate 12 which is bolted to the webs 1*a* of the rails 1 and 1' by means of screws or bolts 15. The connecting plate 12 is analogously provided with a safety against slippage edge 12*d* cooperating with the rail suspending element 3 in the same or in an analogous manner as was outlined above. Only one of these bolts 5*a* is illustrated but, of course, as can be seen particularly from FIG. 3 there are eight such screws or bolts provided for effecting a connection involving a single connecting plate 12. The head of these various bolts will not interfere with any collecting conductor as it may be connected to the rail system provided, of course, this collecting conductor is not directly in abutment with a bar or web 1*a*. The plate 3 of the rail suspension structure may be connected to web 1*a* by means of a bolt or pin 6.

One can readily see that the particular construction provided for interconnecting two rails as per the two examples are characterized by elements which inherently include overhung portions such as 2*d* or 12*d* for purposes of receiving extending parts of the suspension structure for the rails or the rail system as a whole.

The invention is not limited to the embodiments described above but all changes and modifications thereof not constituting departures from the spirit and scope of the invention are intended to be included.

We claim:

1. A rail connection for use in an overhead suspended rail system including a rail to be connected to at least one adjoining rail, a connecting structure comprising a connecting plate bolted to the web of the rail in flat abutment therewith and having a portion extending beyond the rail for connection to the adjoining rail, the plate further having lateral extensions for abutment with a suspension element, there being safety edges to prevent the plate as connected to the rails from laterally slipping off.

2. A connecting structure for interconnecting abutting ends of two rails, the rails provided for an overhead suspended rail system, each of the rails having an upper and a lower flange and a web portion interconnecting the respective upper and lower flange comprising:

a first connecting structure physically separate from but in abutment with the upper flange and secured to the web adjacent thereto and for each of said two rails and having an overhung portion as well as an undercut surface underneath the overhung portion;

a second connecting structure analogously physically separate from but in abutment with the lower flanges of the two rails and also secured to the webs of the two rails, also having an overhung portion as well as an undercut surface above the overhung portion;

said first and second connecting structure including a common and integral plate bolted to the webs of the two rails; and a suspension element by means of which the rails are suspended having portions in abutment with said undercut surfaces, there being means for urging this suspension element into tight engagement with the undercut surfaces.

* * * * *